US005906125A

United States Patent [19]

Shen

[11] Patent Number: 5,906,125

[45] Date of Patent: May 25, 1999

[54] AUXILIARY LOCK

[76] Inventor: Mu-lin Shen, No. 32, Lane 76, Sec. 5, Fu-an Rd., Tainan, Taiwan

[21] Appl. No.: 08/955,574

[22] Filed: Oct. 22, 1997

Related U.S. Application Data

[63] Continuation of application No. 08/661,435, Jun. 13, 1996, abandoned.

[51] Int. Cl.[6] ..... E05B 9/08

[52] U.S. Cl. ..... 70/370; 70/417; 70/449; 70/451; 70/452

[58] Field of Search ..... 70/370, 373, 371, 70/447–449, 417, 450, 452, DIG. 60

[56] References Cited

U.S. PATENT DOCUMENTS

| | | | |
|---|---|---|---|
| 3,514,983 | 6/1970 | Krook et al. | 70/370 |
| 3,550,411 | 12/1970 | Neary et al. | 70/370 |
| 4,272,974 | 6/1981 | Hennessy | 70/370 |
| 4,338,804 | 7/1982 | Solovieff | 70/452 |
| 4,548,061 | 10/1985 | Nilsson | 70/370 |
| 4,841,754 | 6/1989 | Jones | 70/452 |
| 5,010,749 | 4/1991 | Lin | 70/190 |
| 5,186,030 | 2/1993 | Lin | 70/449 |
| 5,216,910 | 6/1993 | Lin | 70/370 |
| 5,722,273 | 3/1998 | Lin et al. | 70/370 |

*Primary Examiner*—Steven Meyers
*Assistant Examiner*—Tuyet-Phuong Pham
*Attorney, Agent, or Firm*—Hamilton, Brook, Smith & Reynolds, P.C.

[57] ABSTRACT

An auxiliary lock includes a cylinder which includes a tailpiece projected from one end thereof, a cylinder housing firmly receiving the cylinder therein and including a hollow protrusion projected from a shoulder thereof, a trim rotatably receiving the cylinder housing therein, a ring defining an opening at a center thereof and including a first flange extending around the opening and a second flange formed around a periphery of the ring at an opposite surface from which the first flange projects. The disk-like hollow protrusion is received in the opening of the ring, with the shoulder of the cylinder housing being in contact with the ring and an end portion of the trim being rotatably received in the second flange of the ring. A first engagement plate is engaged to a second engagement plate which is installed with a knob. The knob is engaged to the tailpiece of the cylinder and is manually controllable to rotate the tailpiece, which in turns rotates the cylinder to unlock or lock the auxiliary lock. The first engagement plate and the second engagement plate including the knob are installed in an inside surface of a door, while the cylinder, the cylinder housing, the trim, and the ring are installed on an outside surface of the door. The trim, when rotated by an external force, will rotate with respect to the ring but will not drive the cylinder to rotate.

3 Claims, 8 Drawing Sheets

AUXILIARY LOCK

RELATED APPLICATION

This application is a continuation of application Ser. No. 08/661,435, filed on Jun. 13,1996 now abandoned which is incorporated herein by reference in its entirety.

BACKGROUND OF THE INVENTION

1. Field of the Invention

The present invention relates to an auxiliary lock, especially one which reduces invading damage to the lock by a intruder.

2. Description of the Prior Art

Normally an auxiliary lock is installed on a door for further locking the door in addition to an entrance lock. However, a thief can damage the auxiliary lock by forcedly rotating the lock with pliers, screwdrivers, or the like. Additionally, a thief can damage the auxiliary lock by applying an impact on the auxiliary lock with a hammer or the like. Therefore, it is requisite to provide an improved lock which can reduce the possibility of invading damage to the lock.

SUMMARY OF THE INVENTION

The primary objective of the present invention is to provide an auxiliary lock which can reduce an impact damage to a minimum level.

Another objective of the present invention is to provide an auxiliary lock which can prevent an intruder from damaging the lock by forcedly rotating it.

In accordance with one aspect of the invention, there is provide d an auxiliary lock including a cylinder firmly received in a cylinder housing which is receive in a trim. The trim is so sized that it can rotate with respect to the cylinder housing. The cylinder has a tailpiece firmly projected therefrom. The cylinder housing has a disk-like hollow protrusion projected from a shoulder thereof. A ring which defines an opening at a center thereof includes a first flange formed around the opening and a second flange formed around a periphery of the ring at an opposite surface from which the first flange projects. The disk-like hollow protrusion is received in the opening of the ring, with the shoulder of the cylinder housing being in contact with the ring and an end portion of the trim being rotatably received in the second flange of the ring. A first engagement plate is engaged to a second engagement plate which is installed with a knob thereof. The knob is engaged to the tailpiece of the cylinder and is manually controlled to rotate the tailpiece which in turns rotates the cylinder. The first engagement plate and the second engagement plate including the knob are installed in an inside surface of a door, while the cylinder, the cylinder housing, the trim, and the ring are installed on an outside surface of the door. The door has a bore hole which is sized to exactly receive the first flange of the ring. The ring evenly releases an impact to the door when the trim experiences malicious, violent impact, thus reducing the impact damage to the auxiliary lock to a minimum level. The trim is forced to rotate when it is manually rotated by a pair of pliers of an intruder, while the cylinder housing will not be affected by the rotation of the trim.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
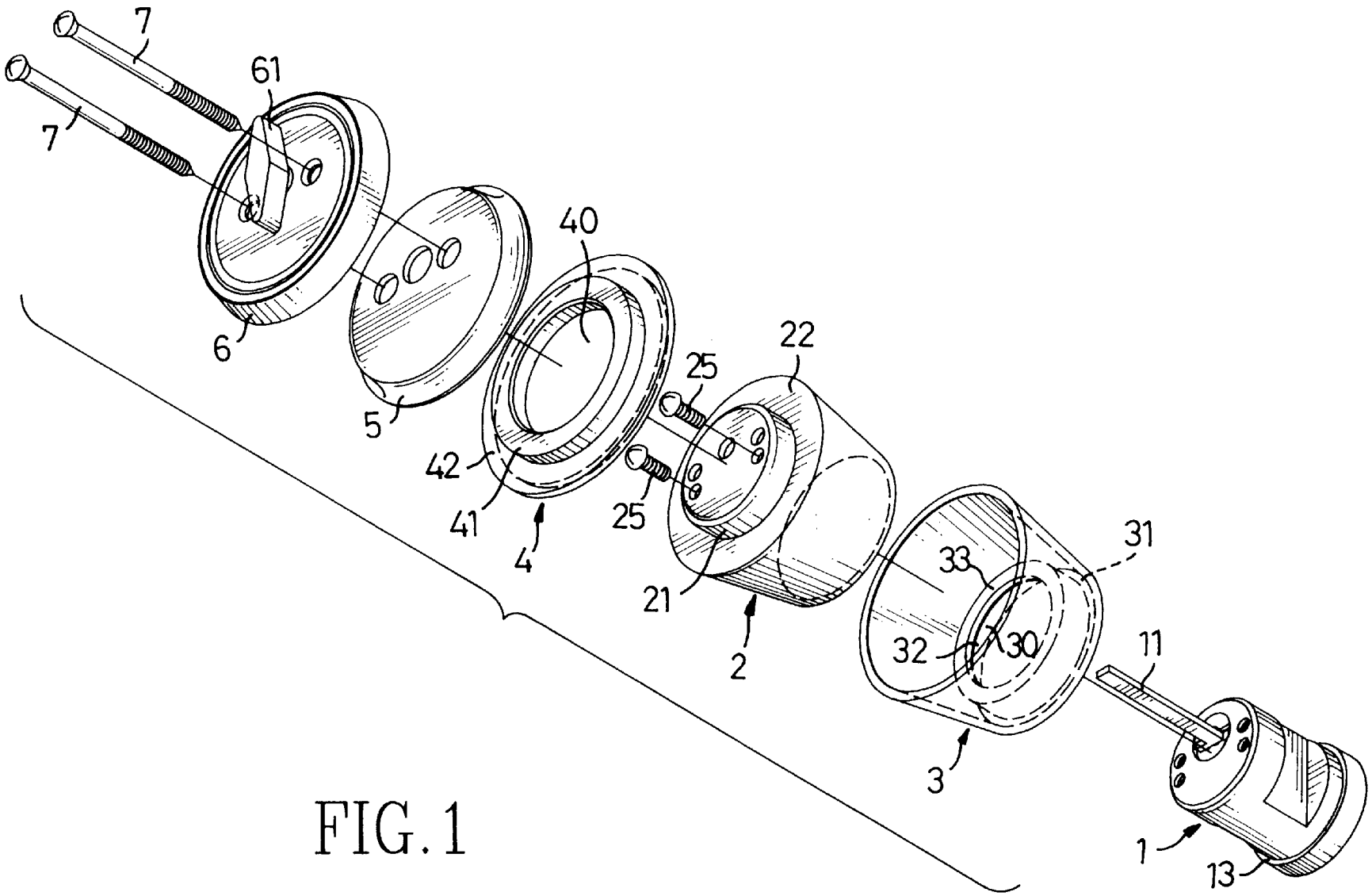
FIG. 1 is an exploded view of an auxiliary lock in accordance with the present invention.

Referring to the drawings and particularly to FIG. 1, an auxiliary lock in accordance with the present invention comprises a cylinder 1 which includes a tailpiece 11 projected from one end thereof. A cylinder housing 2 firmly receives the cylinder 1 therein and includes a hollow protrusion 21 projected from a shoulder 22 thereof. There are two first threaded holes (not labeled) defined in the cylinder 1 and the cylinder housing 2 allowing two screws 25 to firmly engage the cylinder 1 in the cylinder housing 2. The cylinder 1 has two second threaded holes (not labeled) defined therein for other engagement purpose as explained later. A trim 3 rotatably encloses the cylinder housing 2 therein. More specifically, the trim 3 includes a first flange 31 formed around an opening 30 thereof and a second flange 32 projected perpendicularly from a peripheral edge of the first flange 31 thus defining a space between an inner wall of the trim 3, the first flange 31, and the second flange 32 for receiving an end portion of the cylinder housing 2.

Figure 2B:
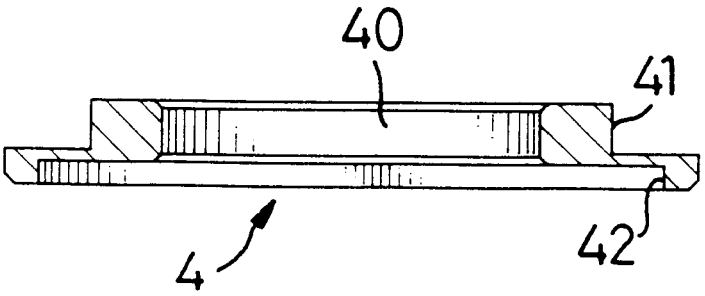
FIG. 2B is a cross-sectional view of the ring of FIG. 2A.
Figure 2A:
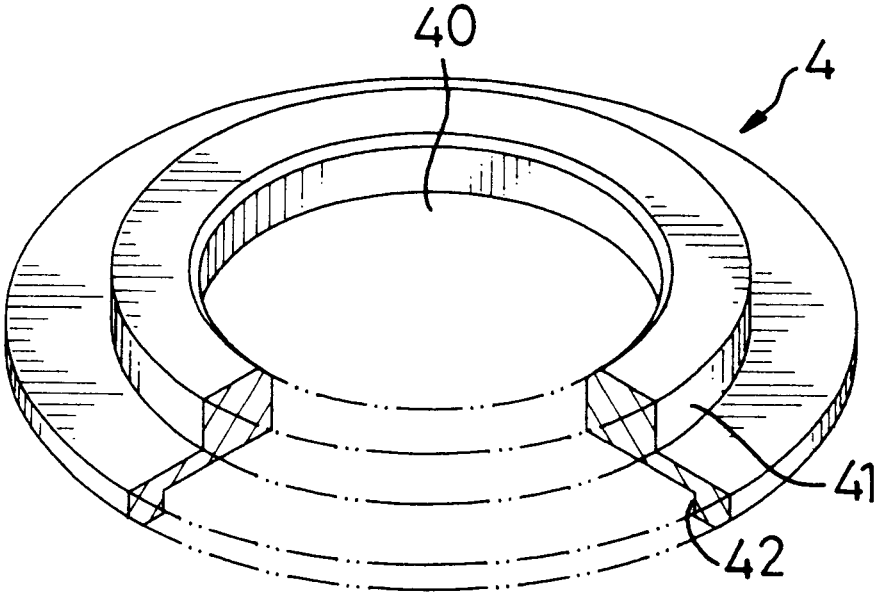
FIG. 2A is a perspective view of a ring of a first embodiment of the auxiliary lock in accordance with the present invention, where the phantom lines attempt to show a flange in an opposite side of the Figure.

Also referring to FIGS. 2A and 2B, a ring 4 defines an opening 40 at a center thereof and includes a first flange 41 formed around the opening 40 and a second flange 42 formed around a periphery of the ring 4 at an opposite surface from which the first flange 41 projects. The disk-like hollow protrusion 21 is sized to be received in the opening 40 of the ring 4, with the shoulder 22 of the cylinder housing 2 being in contact with the ring 4 and an end portion of the trim 3 being rotatably received in the second flange 42 of the ring 4.

A first engagement plate 5 is firmly engaged to a second engagement plate 6 and together are firmly engaged to the cylinder housing 2 by two bolts 7. It should be noted that there are holes (not labeled) defined in the first engagement plate 5, the second engagement plate 6, and the cylinder housing 2 in appropriate positions for receiving the two bolts 7 to extend therethrough so that they may threadedly engage in the two second threaded holes (not labeled) in the cylinder 1. The second engagement plate 6 is installed with a knob 61 which is engaged to the tailpiece 11 of the cylinder 1 and is manually controllable to rotate the tailpiece 11, thus unlocking (opening) or locking (closing) the auxiliary lock.

Figure 2:
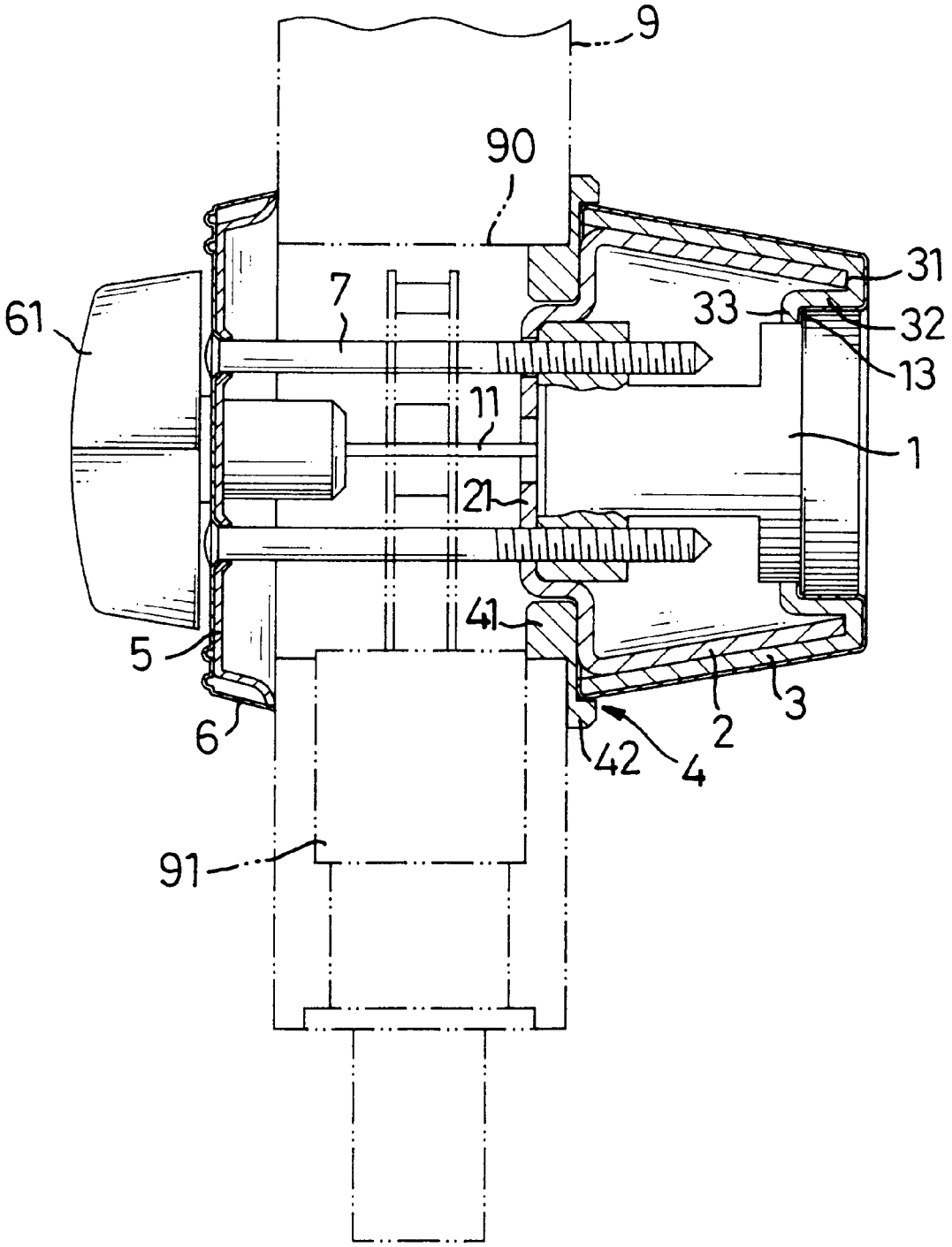
FIG. 2 is an assembled view of the auxiliary lock of FIG. 1 shown in a cross-sectional view and the auxiliary lock is installed on a door.

Particularly referring to FIG. 2, the cylinder 1 has a shoulder 13 formed around a periphery thereof. The trim 3 has a third flange 33 extending from the second flange 32 and encircling the opening 30. The shoulder 13 of the cylinder 1 abuts against the third flange 33 when the auxiliary lock is assembled and installed in a door 9. From FIG. 2, it can be seen that the first engagement plate 5 and the second engagement plate 6 including the knob 61 are installed in an inside surface of the door 9, while the cylinder 1, the cylinder housing 2, the trim 3, and the ring 4 are installed on an outside surface of the door 9. The door 9 has a bore hole 90 which is sized to exactly receive the first flange 41 of the ring 4. The ring 4 evenly releases an impact to the door 9 when the trim 3 is experienced malicious, violent impact from an intruder, thus reducing the impact damage to the auxiliary lock to a minimum level. The abutment between the flange 33 of the trim 3 and the shoulder 13 of the cylinder 1 prevents the trim 3 from being pulled out by an intruder's pliers. It should be noted that there are corresponding holes respectively defined in the second engagement plate 6, the first engagement plate 5, the ring 4, the door 9, the cylinder housing 2, the trim 3 allowing the tailpiece 11 to freely rotate when the knob 61 is operated by a user. The tailpiece 11 of the cylinder 1 when rotated by the knob 61 will lock or release a dead bolt 91 thus locking or unlocking the auxiliary lock. The trim 3, when rotated by an external force (for example a force from a pair of pliers by an intruder), will rotate with respect to the ring 4 but not drive the cylinder housing 2 to rotate, therefore the auxiliary lock will not be damaged.

Figure 3:
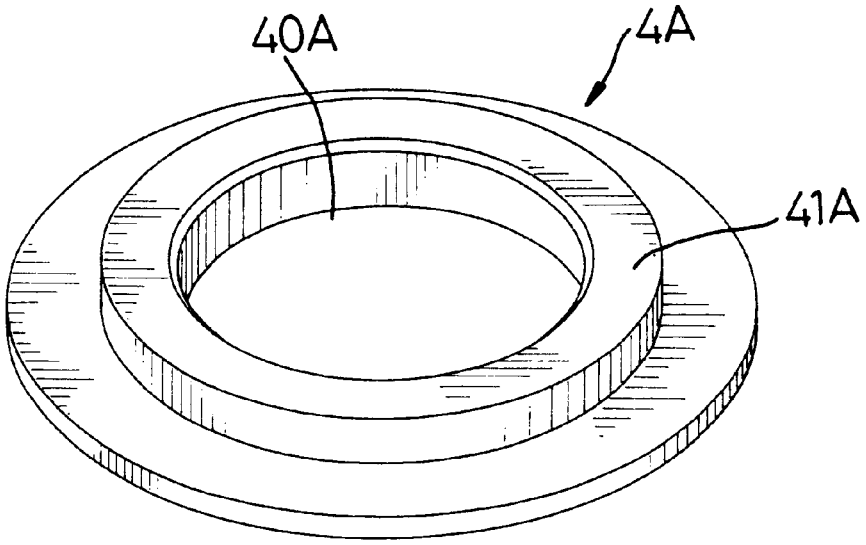
FIG. 3 is a perspective view of a ring of a second embodiment of the auxiliary lock in accordance with the present invention.
Figure 4:
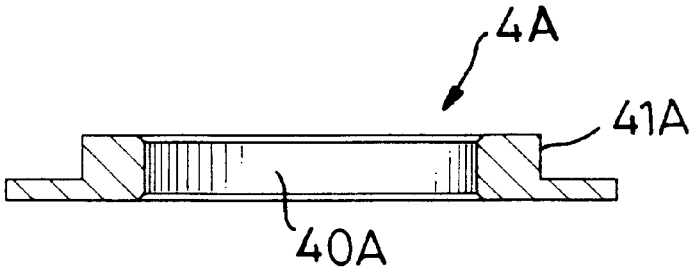
FIG. 4 is a cross-sectional view of the ring of FIG. 3.
Figure 5:
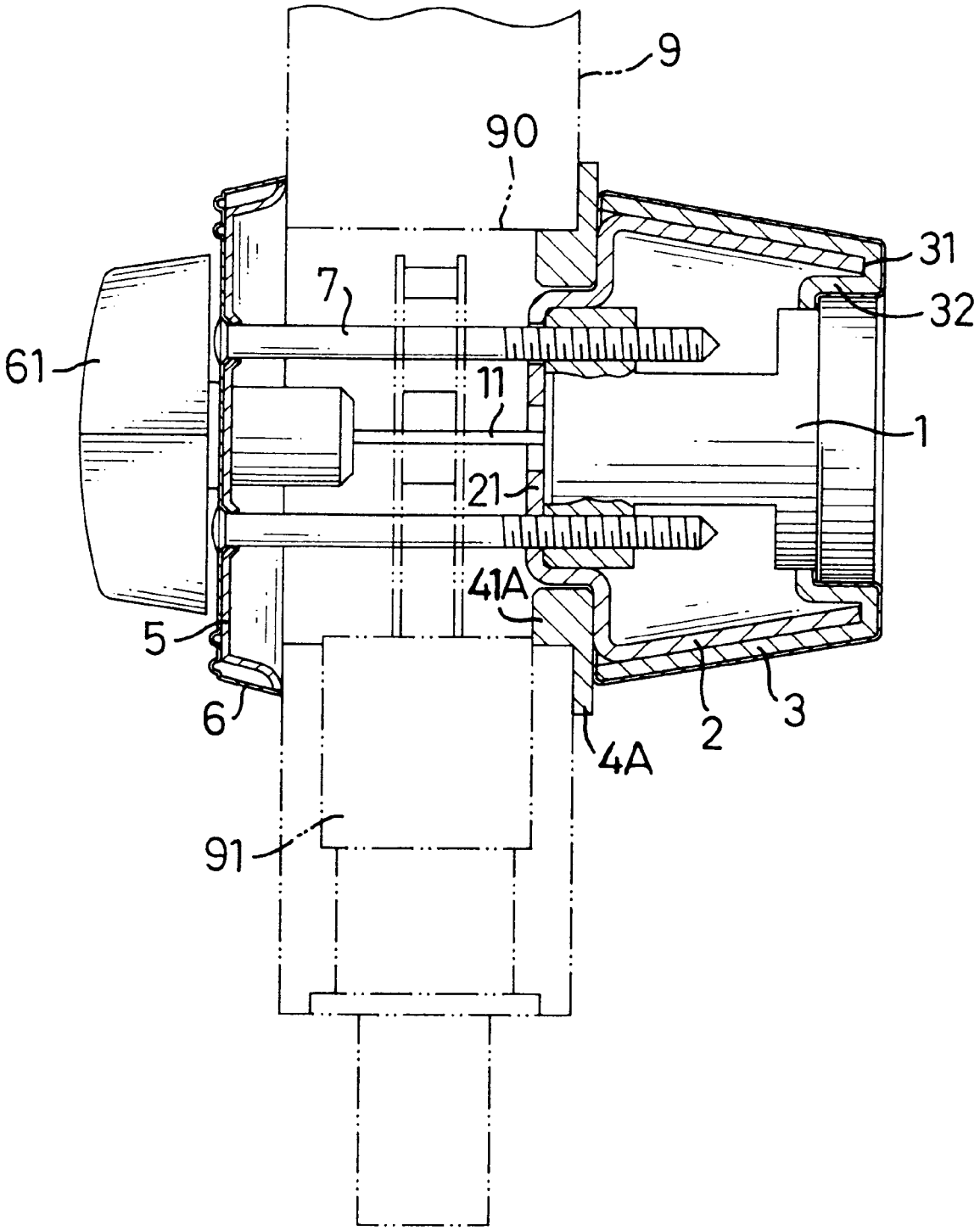
FIG. 5 is a second embodiment of the auxiliary lock of the present invention, where the lock is installed in a door.

In a second embodiment, all the components of the auxiliary lock are exactly the same with those of the first embodiment, except the ring 4. In the second embodiment, a ring 4A is used to replace the ring 4 of the first embodiment. Referring to FIGS. 3 and 4, the ring 4A is almost the same with the ring 4 of the first embodiment, except that it lacks the second flange 42. The ring 4A defines an opening 40A at a center thereof. A flange 41A projects from the ring 4A and it encloses the opening 40A. FIG. 5 illustrates an assembled view of the second embodiment, where one end other trim 3 is in contact with the ring 4A and it is rotatable with respect to the ring 4A. In this embodiment, the ring 4A will also release an impact to the door 9, if a hammer is used to hit the trim 3. No matter in what direction the hammer hits the trim 3, most of the impact will be released to the door 9 via the ring 4A. The trim 3 will rotate with respect to the cylinder housing 2 when it is rotated by a clamp or the like from a thief, therefore an enforced rotation on the trim 3 will not damage the lock.

Figure 6:
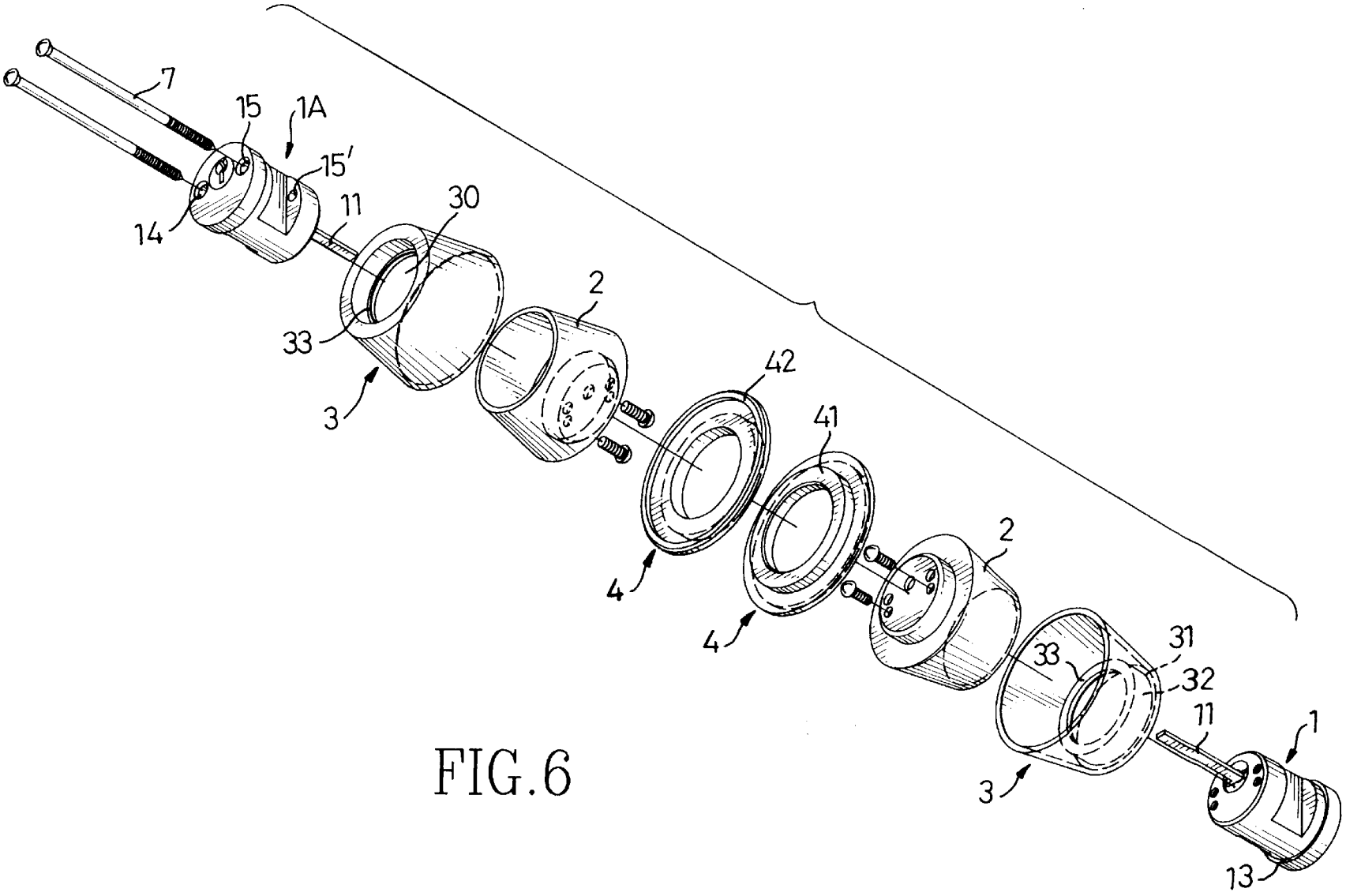
FIG. 6 is an exploded view of a third embodiment of the auxiliary lock of the present invention, where the inside surface and the outside surface of the door are installed with substantially the same parts of the lock.
Figure 7:
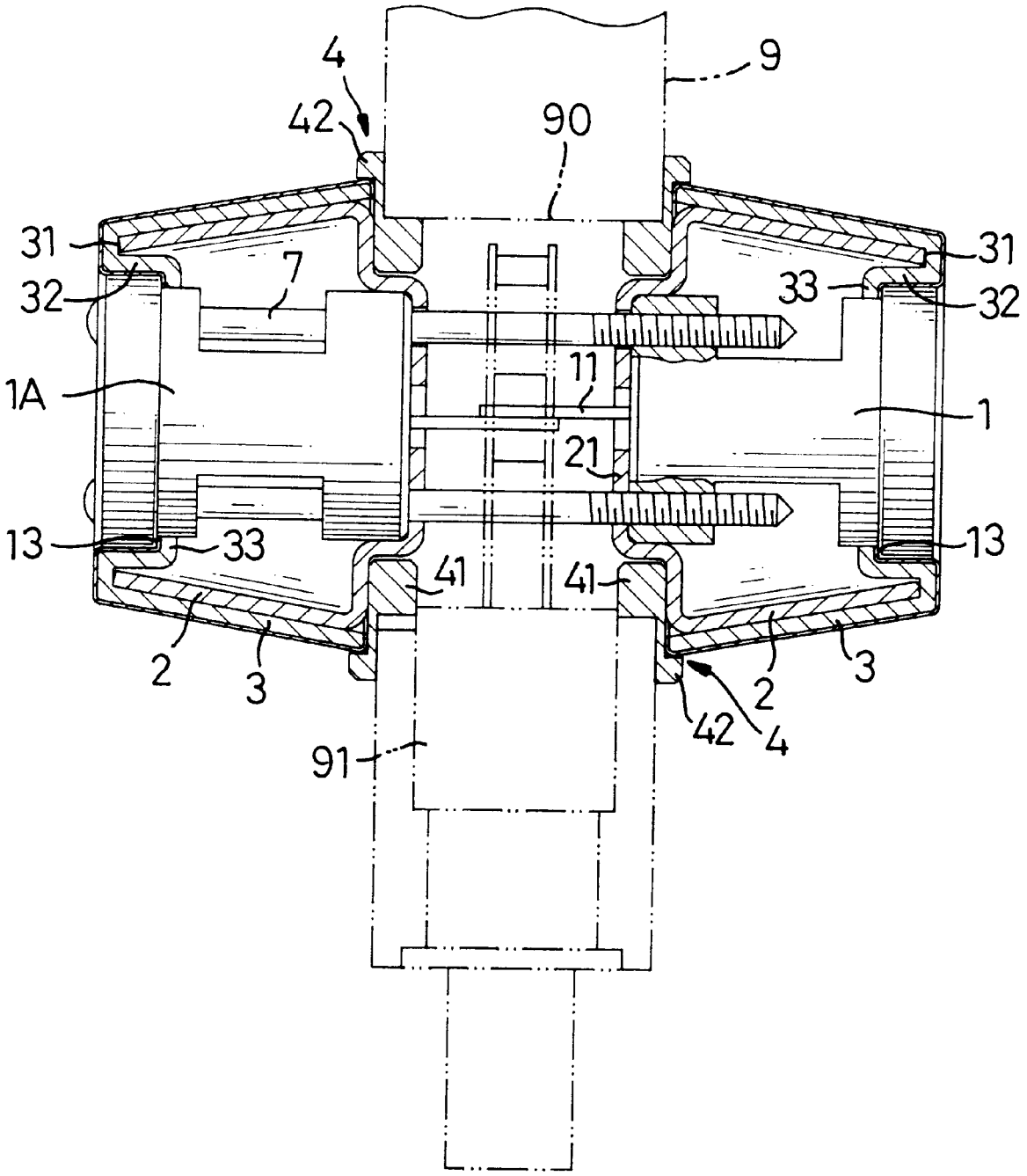
FIG. 7 is an assembled view of the third embodiment of the auxiliary lock of the present invention.
Figure 8:
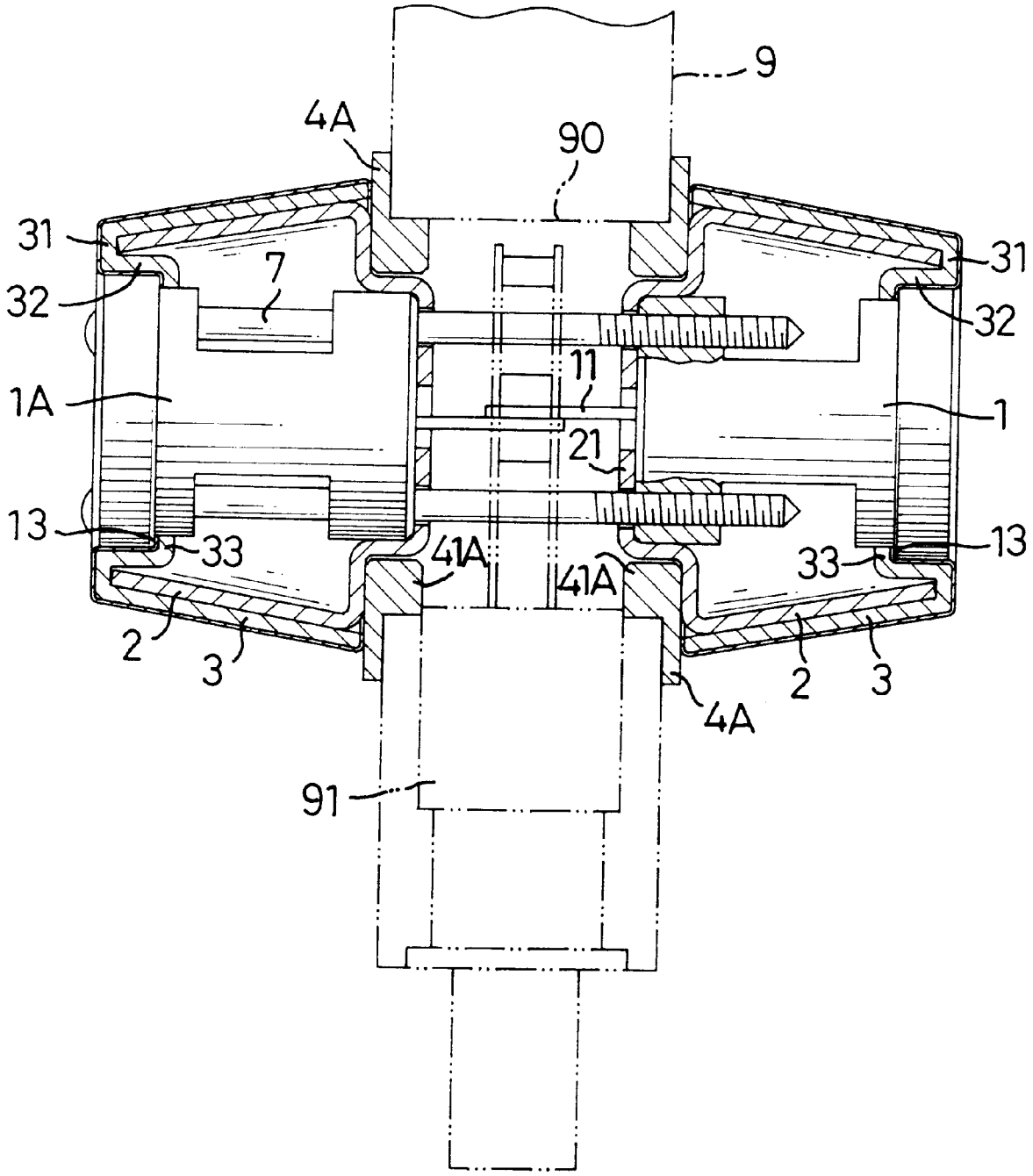
FIG. 8 is an assembled view of a fourth embodiment of the auxiliary lock of the present invention.

In a third embodiment of the auxiliary lock in accordance with the present invention, the parts used in the outside surface of the door 9 of the first embodiment are used in the inside surface of door 9 to replace the first engagement plate 5, the second engagement plate 6, and the knob 61. FIGS. 6 and 7 respectively illustrate an exploded view and an assembled view of the third embodiment of this invention. Since the parts, the corresponding reference numbers, and the functions thereof are exactly the same to those mentioned in the first embodiment, therefore, the detailed are not repeated herein. There are only minor modifications in the cylinder installed in the inside surface of the door 9, named cylinder 1A. Cylinder 1A additionally defines three holes 14, 15, and 15' for receiving the two bolts 7, where the holes 15 and 15' are in alignment with each other for receiving a same bolt 7. The bolts 7 should be installed in the inside surface of the door 9 avoiding being released by a thief.

In a fourth embodiment, the parts of the auxiliary lock are exactly identical to those of the third embodiment, except that the ring 4 is replaced with the ring 4A used in the second embodiment. Since the structure and the functions of the fourth embodiment is well understood from the previous three embodiments, the detailed thereof are omitted therein.

I claim:

1. An auxiliary lock sub-assembly for a door comprising:

a) a ring having a central opening and a first flange shaped and sized for being received in a door bore-hole;

b) a cylinder housing having a shoulder abutting the ring and a hollow protrusion extending into the central opening of the ring, the hollow protrusion having a flat outer wall;

c) a trim enclosing over the cylinder housing;

d) a cylinder having a rear end received within the hollow protrusion of the cylinder housing and a shoulder abutting the trim, the flat outer wall of the protrusion being intimately interposed between the ring and the rear end of the cylinder; and e) means for retaining the cylinder housing and the trim in a fixed relationship with respect to the door, wherein the ring further has a second flange, and a free end of the trim adjacent to the shoulder of the cylinder housing is situated between the shoulder of the cylinder housing and the second flange of the ring.

2. The auxiliary lock sub-assembly as claimed in claim 1, wherein the ring is a solid metal piece.

3. The auxiliary lock sub-assembly as claimed in claim 1, wherein the trim is rotatably mounted to the cylinder housing.

* * * * *